US005157996A

United States Patent [19]

Keyvani

[11] Patent Number: 5,157,996

[45] Date of Patent: Oct. 27, 1992

[54] TOOL

[76] Inventor: Daryoush Keyvani, 321 S. Sherbourne Dr., #109, Los Angeles, Calif. 90048

[21] Appl. No.: 671,257

[22] Filed: Mar. 18, 1991

[51] Int. Cl.[5] ..... B25B 7/06

[52] U.S. Cl. ..... 81/416; 30/131; 30/257; 81/418; 81/427.5

[58] Field of Search ..... 81/300, 415, 416, 418, 81/427.5; 30/131, 257

[56] References Cited

U.S. PATENT DOCUMENTS

| | | | |
|---|---|---|---|
| 541,294 | 6/1895 | Smith | 30/257 |
| 1,093,726 | 4/1914 | Pearson | 30/257 |
| 1,845,798 | 2/1932 | Keiser | 30/257 |
| 2,508,805 | 5/1950 | Scott | 30/131 X |
| 3,156,980 | 11/1964 | Vosbikian | 30/257 X |

FOREIGN PATENT DOCUMENTS

| | | | |
|---|---|---|---|
| 3871 | 4/1901 | Austria | 30/131 |

*Primary Examiner*—James G. Smith
*Attorney, Agent, or Firm*—Lawrence S. Cohen

[57] ABSTRACT

A tool of the type having two handles and a pivot axis, and two extension members longitudinal axially aligned with the pivot axis and each attached at one end to one of the handles and having at the other end working tool members positioned for opposed operation so that the handles operate in one plane and the working tool members operate in a parallel offset plane.

2 Claims, 2 Drawing Sheets

TOOL

BACKGROUND OF THE INVENTION

The invention relates to pivoting handle tools of the type having two handles, a pivot center and a pair of opposed working tool elements.

SUMMARY OF THE INVENTION

The invention provides a pair of pivoting handles and a pair of working tool members such as plier jaws or cutter blades in which the working tool members operate in a plane offset from the plane of the handles. The offset is provided by extension members attached to each handle at the pivot center. In a particular embodiment this is accomplished by a tube attached to one handle centered on the pivot center axis, and a rod attached to the other handle inside the tube and also centered on the pivot center axis. At the other end of the tube and rod the working tool members are attached for opposed operation. A portion of the rod is exposed in order to allow its associated working tool member to be attached. In one embodiment the tube has an aperture which exposes a portion of the rod, and the working tool member is attached to the exposed area. In another embodiment the rod extends beyond the end of the tube and the working tool member is attached to the extended portion of the rod.

In another embodiment, the handles are in different planes, where the handle which is attached to the rod is so attached through an aperture in the tube. This embodiment is typically applicable to large tools such as used for fruit picking or branch cutting. Also a receiving tube can be attached to receive cut fruit.

DETAIL

Figure 1:
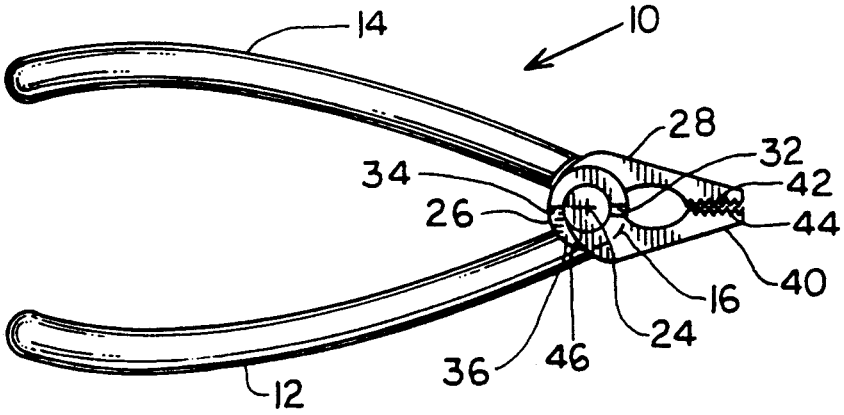
FIG. 1 is a top view of one embodiment of the invention.
Figure 2:
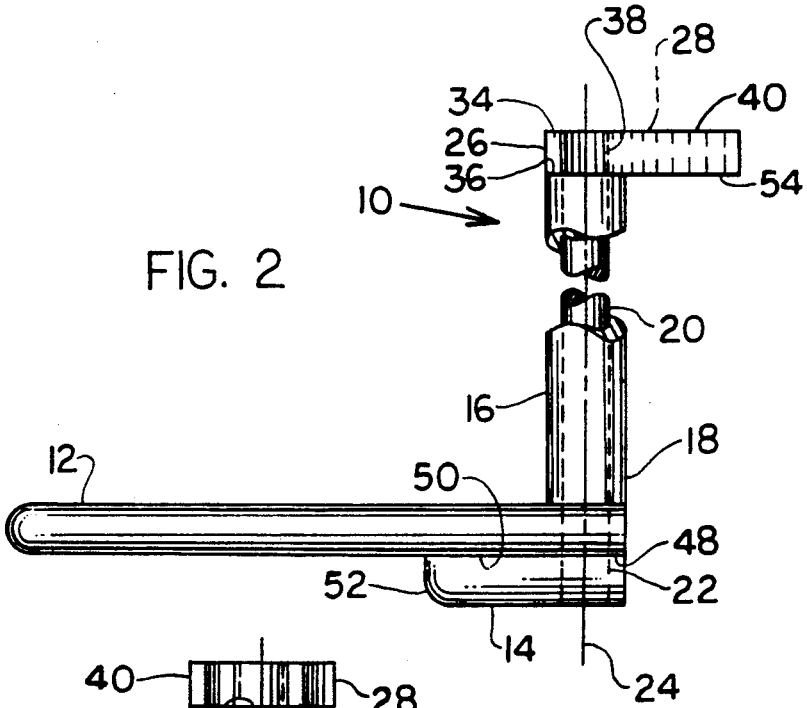
FIG. 2 is a side view of the embodiment of FIG. 1.
Figure 3:
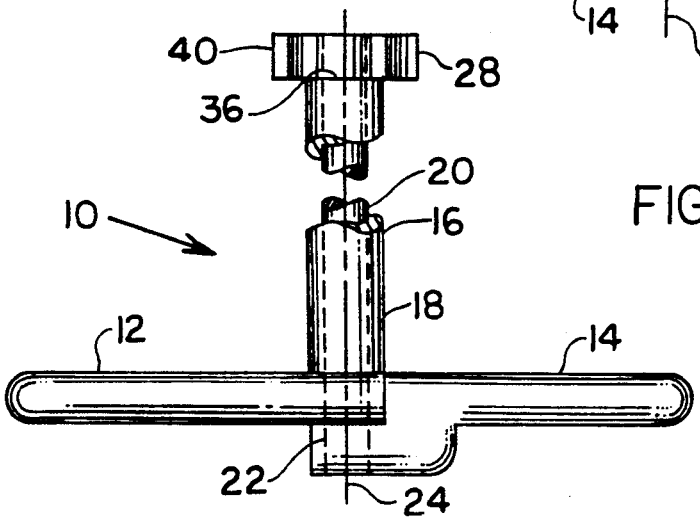
FIG. 3 is a front view of the embodiment of FIG. 1.

Referring to FIG. 1, 2 and 3 there is shown an embodiment of the invention as a plier 10. The plier 10 has a first handle 12, and a second handle 14. The first handle 12 is attached to a tube 16 at a lower end 18. The second handle 14 is attached to a rod 20 at the lower end 22. The rod 20 may be solid o a tube. Both the rod and the tube have a longitudinal axis which is co-extensive and is also co-extensive with a pivot center axis 24 of the handles 12 and 14. The rod 20 extends inside the tube 16 so that they are free for respective rotation about the pivot center axis 24.

The first and second handles 12 and 14 are in the same plane and can operate between a closed position and an open position by rotating around the pivot center axis 24 which is orthoganal to the plane of operation of the handles 12 and 14.

The tube 16 extends for a selected distance depending on the amount of offset desired. Examples may be 6" or 10". The tube terminates in an upper end 26 and has attached to it a working tool member, in this case a first plier grip 28. There is also an aperture in the upper end, the aperture being a rectangular shape formed by removing a piece of the tube and the aperture being defined by vertical walls 32 and 34 and a horizontal wall 36. The aperture extends around the tube a preselected amount for example 180°. The angular extent of the aperture is determined by the amount of angular movement desired between the open and closed positions.

The rod 20 terminates in a upper end 38 of which a portion is exposed. The exposed portion has attached to it a working tool member in this case a second plier grip 40. The second plier grip 40 is attached to the portion of the rod left exposed by the aperture. The first plier grip 24 has a jaw 42 and the second plier grip 40 has a jaw 44. Also, the second plier grip 40 has a stop surface 46. FIG. 1 shows this construction in a closed position with the jaws 42 and 44 touching while the handles 12 and 14 are relatively close together in the closed position.

FIG. 3 shows the open position of the plier grips 28 and 40. As can be seen from FIG. 1, upon rotation of the jaws 28 and 40 into an open position the furthest extent of the open position will be limited by the aperture wall 34 and the stop surface 46 coming into contact.

The tube 16 will be placed such that its lower terminal end 48 contacts an upper surface 50 of an offset portion 52 of second handle 14 thus limiting its downward movement. Also a lower face 54 of the second grip plier 40 will bear against the wall 36 of the aperture in order to limit movement. Thus the rod 20 and tube 16 are controlled against relative axial movement so that the handles 12 and 14 will operate in one plane and the plier grips 28 and 40 will operate in a parallel plan offset from the plane of the handles.

Figure 4:
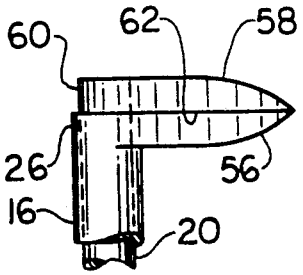
FIG. 4 is a partial side of an alternative embodiment of the invention.
Figure 5:
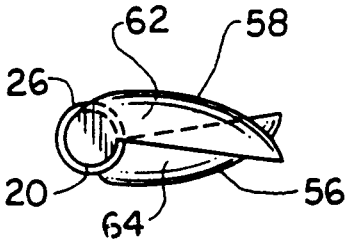
FIG. 5 is a partial top view of the embodiment of FIG. 4

Another embodiment is shown in FIGS. 4 and 5. In this embodiment the working tool element is a cutter comprising a first cutter member 56 attached to an upper end 26 of the tube 16 and a second cutter member 58 attached to an upper exposed portion 60 or the rod 20. In this case, exposure of the exposed portion 60 is provided by the rod 20 extending beyond the upper end 26 of the tube 16. The cutter blades 56 and 58 are arranged to cross when moved from the open to the closed position of the tool, the closed position being shown in FIG. 5.

In this embodiment relative axial movement between the tube and the rod is controlled by contact of a lower face 62 of the second cutter 58 against an upper face 64 of the first cutter 56. The lower elements of the tool, not shown in FIG. 3, 4 and 5 are constructed as shown in FIGS. 1, 2 and 3.

Figure 6:
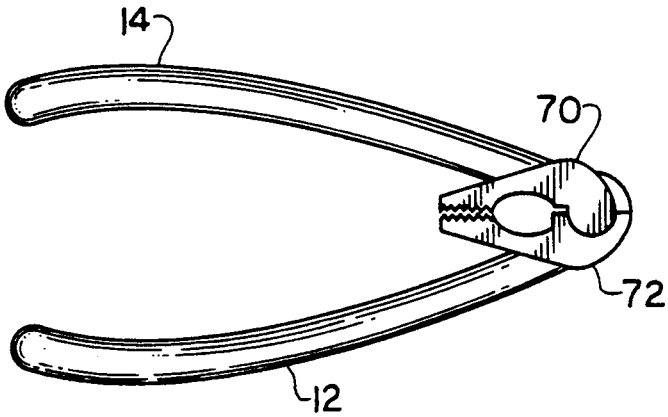
FIG. 6 is a top view of another embodiment of the invention.

Another embodiment is shown in FIG. 6. This embodiment is constructed as described above except that the plier grip members 70 and 72 are facing toward the handles 12 and 14. Notably in the construction of FIGS. 1-5, (looking down as in FIG. 1) the left handle 14 is connected to the second plier grip 40 on the right and the right handle 12 is connected to the first plier grip 28 on the left, which is the normal crossed—pivot construction for such a tool. In the embodiment of FIG. 6 the left handle 14 is connected to the left plier grip 70 and the right handle 12 is connected to the right plier grip 72. Also, in this embodiment, the right plier grip 72 is attached to the right handle 12 by a tube (not shown) and the left plier grip 70 is attached to the left handle 12 by a rod (not shown) this assembly being the same as described above for FIGS. 1-6.

It should also be appreciated that the jaws having been shown in FIG. 1 to be aligned forwardly with the handles (zero degrees orientation) and FIG. 6 aligned rearwardly (180 degrees orientation); the jaws can be set at any other orientation such as 90 degrees or 45 degrees.

It should also be appreciated that any configuration of jaw functions which are possible on a cross-pivot tool device can be implemented in this invention. For example a pair of blades which come into contact, needlenose pliers, etc.

The invention can be adapted for any size or type of application. In particular it can be adapted for dental use or medical use.

In operation, pivoting of the handles from their closed position to an open position will operate the tool members from a closed position to an open position, the reverse process also being true, as is the case in normal single plane tools. By means of the planar offset available with the extension means of the invention, the tool can be applied to a work piece in an offset plane.

Figure 7:
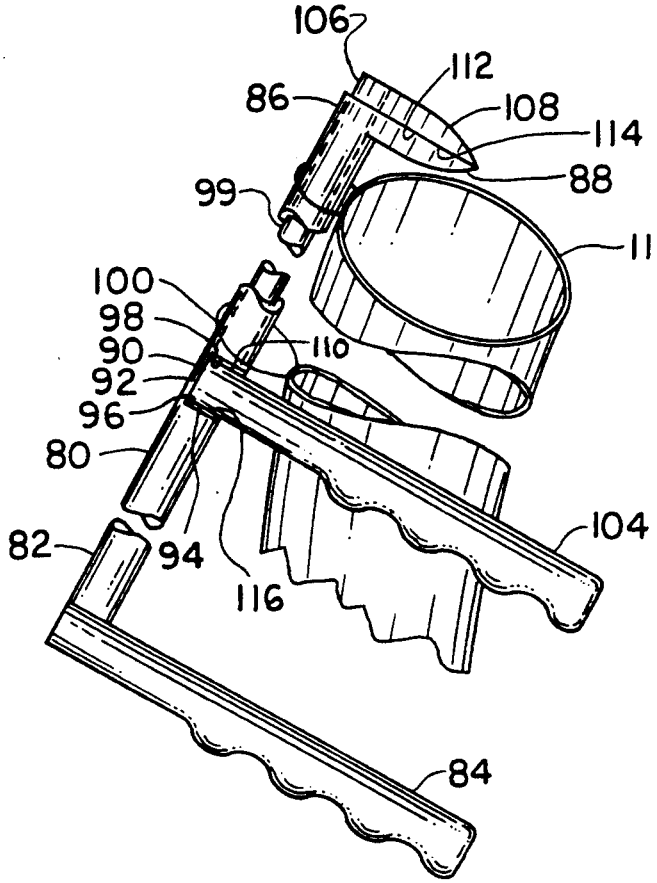
FIG. 7 is a side view of another embodiment of the invention.

Another embodiment of the invention is available for more gross work such as cutting fruit. This embodiment is shown in FIG. 7. In this construction a tube 80 is of selected length to reach for example near the top of a tree. At a lower end 82 of the tube 80 is a handle 84. At an upper end 86 of the tube 80 is a cutter 88. Also the tube has a rectangular aperture 90 formed by vertical walls 92 and 94, and horizontal walls 96 and 98.

Inside the tube 80 is a rod 99. At a lower end of the rod 99 there is an exposed portion, through the aperture 90 to which is attached a handle 104. At an upper end 106 of the rod 99 there is an attached cutter 108. Contact of an upper surface 110 of the handle 104 with the aperture wall 98 along with contact of a lower surface 112 of the cutter 108 with an upper surface 114 of the cutter 88 keeps the entire assembly in axial position for good operation of the cutter blades. Alternatively axial position can be fully maintained by a separate locating means comprising coacting elements on the tube 80 and the rod 99 located anywhere along their length. In one particular, the lower surface 96 of the aperture may contact a lower surface 116 of the handle 104 to coact with surfaces 98 and 110 as above described to fully control axial position.

Also as a part of this apparatus there may be a pipe 118 which can be fitted below the cutters 88 and 108 so that fruit which has been cut off a tree will fall into the pipe 118 and be directed to a desired location.

Although particular embodiments of the invention have been described and illustrated herein, it is recognized that modifications and variations may readily occur to those skilled in the art, and consequently it is intended that the claim be interpreted to cover such modifications and equivalents.

I claim:

1. A tool for cutting comprising:

a tube having a lower end and an upper end and a first handle attached to the tube near its lower end and a first cutting tool attached to the tube near its upper end and aperture in the tube between its lower end and its upper end, a rod inside the tube having an exposed portion exposed by the aperture and an upper end having an exposed portion near the upper end of the tube and a handle attached to the exposed portion of the rod exposed by the aperture and a second cutting tool attached to the exposed portion of the rod near the upper end;

the first and second cutting tools being adapted to co-act for cutting operation;

means to maintain the tube and the rod in longitudinal axial position to maintain the cutting tools in operable position.

2. The tool of claim 1 further comprising a pipe extending from a point below the cutting tools to a preselected deposit point.

* * * * *